US008344035B2

(12) United States Patent
Comolli et al.

(10) Patent No.: US 8,344,035 B2
(45) Date of Patent: Jan. 1, 2013

(54) TIRE RECYCLING METHOD GENERATING CARBONOUS RESIDE

(75) Inventors: Alfred G. Comolli, Yardley, PA (US); David L. Tanner, Citrus Heights, CA (US)

(73) Assignee: Senergy LLC, Chadds Ford, PA (US)

( * ) Notice: Subject to any disclaimer, the term of this patent is extended or adjusted under 35 U.S.C. 154(b) by 0 days.

(21) Appl. No.: 12/880,829

(22) Filed: Sep. 13, 2010

(65) Prior Publication Data

US 2011/0053106 A1 Mar. 3, 2011

Related U.S. Application Data

(62) Division of application No. 12/147,948, filed on Jun. 27, 2008, now Pat. No. 7,795,319.

(60) Provisional application No. 60/947,094, filed on Jun. 29, 2007.

(51) Int. Cl.
*C08J 11/04* (2006.01)

(52) U.S. Cl. ..... 521/41; 521/40; 521/43; 521/46; 423/449.7; 528/480; 528/481; 528/503

(58) Field of Classification Search ..... 521/40, 521/40.5, 41, 41.5, 42, 43, 44, 45.5, 46, 46.5, 521/47, 48, 49; 528/480, 481, 503; 423/449.7
See application file for complete search history.

(56) References Cited

U.S. PATENT DOCUMENTS

| | | | | |
|---|---|---|---|---|
| 4,960,440 | A | 10/1990 | Betz | |
| 5,389,691 | A * | 2/1995 | Cha et al. | 521/41 |
| 5,470,384 | A | 11/1995 | Cha et al. | |
| 5,735,948 | A | 4/1998 | Cha et al. | |
| 6,103,205 | A | 8/2000 | Wojtowicz et al. | |
| 7,615,101 | B2 | 11/2009 | Holmes et al. | |
| 2002/0042465 | A1 | 4/2002 | Migliarini et al. | |
| 2007/0168213 | A1 * | 7/2007 | Comrie | 705/1 |

OTHER PUBLICATIONS www.EnergyJusticeNetwork.net/tires, Jan. 4, 2012, "What is Tire Derived Fuel and Why is it Dangerous?", pp. 1-8, and Attachment A: "Environmental and Health Consequences from Using Tires as Fuel; Health Risk Assesssment", p. 1.*

Nolan, Paul S. et al., Demonstration of Additive Use for Enhanced Mercury Emissions Control in Wet FGD Systems, Fuel Processing Technology, vol. 85, pp. 587-600, Jun. 15, 2004.

* cited by examiner

*Primary Examiner* — Frances Tischler

(74) *Attorney, Agent, or Firm* — Gerry J. Elman; Elman Technology Law, P.C.

(57) ABSTRACT

A process for making a carbonaceous material and a carbonous residue from scrap tires is disclosed. Tires are digested in an oil product. Steel and glass fibers are separated. A product enhancing additive comprising halogen based organic or inorganic compounds is added. The resulting carbonaceous material is then cured to create the final product. The produced carbonous residue is well suited for capture of mercury. The present invention has the benefits of providing a use for scrap tires that would otherwise require disposal in a landfill, and also produces a product useful for capturing a harmful element, thereby providing multiple environmental and economic benefits.

14 Claims, 3 Drawing Sheets

TIRE RECYCLING METHOD GENERATING CARBONOUS RESIDE

CROSS-REFERENCE TO RELATED APPLICATIONS

The present application is a divisional application of and claims the benefit of priority from U.S. application Ser. No. 12/147,948, filed Jun. 27, 2008, now U.S. Pat. No. 7,795,319, issued Sep. 24, 2010, which claims benefit of priority from Provisional Application 60/947,094 filed Jun. 29, 2007. The entire disclosures of each of the aforementioned applications are incorporated herein by reference.

FIELD OF THE INVENTION

The present invention relates to a process for recycling scrap tires. More particularly, the present invention relates to a thermal process, a product produced from that thermal process, and apparatus for performing the process.

BACKGROUND

Each year approximately 300 million used tires are discarded. Many of these used tires are put into landfills or, all too often, are disposed of illegally. Such disposal of scrap tires in landfills is becoming increasingly undesirable as significant environmental and social problems are associated with such activity. The availability of landfill space is diminishing, and there has been a national trend toward more stringent regulatory requirements on landfills. Hence, a considerable amount of attention has been devoted recently toward finding alternative uses for and methods of reclaiming scrap tires.

Some research and commercial efforts have been directed toward the development of new uses for old tires. Unprocessed used tires have been used in playgrounds, flower planters, and shoe soles, and tire pieces have been used as gaskets, shims, dock bumpers and shock absorbers. Processed wasted tires are used as fuel in paper plants and cement kilns and as filler in road construction. Paving materials made from a combination of crumb rubber and asphalt may last up to three times as long as customary paving materials. However, because of the high costs associated with the use of scrap tires for roads, this approach has not gained wide acceptance. Studies continue to explore this use of scrap tires in addition to the somewhat more conventional use of tires as crash barriers and impact absorbers around highway and bridge abutments. However, these new applications for used tires or their constituents consume only a minor portion of the annual accumulation of scrap tires.

Another approach to tire recycling is the generation of solid carbonous residues inside a screw reactor system. Here, "carbonous" represents a state-of-the-art term employed in the field of asphalt materials to indicate largely-carbon-containing molecular structures or particulate entities. Systems and methods for producing carbonous residues from recycled tires are known in the art. For example, U.S. Pat. No. 5,389,691 to Cha, et al. discloses such a system and method. It is incorporated herein by reference in its entirety to the extent it is not inconsistent with the present disclosure. There are some differences between the present invention and U.S. Pat. No. 5,389,691, hereinafter referred to as '691, that will be evident from the following description.

The carbonous residues may have a variety of uses, including being used as an additive in certain types of concrete. However, the carbonous residues produced by the aforementioned processes have a limited and specific application range. For example, they are not suitable for various environmental applications, due to low surface area, small pore size and chemical composition. Therefore, what is desired is a carbonous residue and process for making the residue from recycled tires that is suitable for environmental applications.

SUMMARY OF THE INVENTION

The preferred embodiments of the present invention include a process to recycle tires comprising the following aspects digesting the tires at a maximum temperature below about 750 degrees Fahrenheit using an oil being selected from the group consisting of residuum, waste motor oil, new 600 w cylinder oil, trim gas oil, vacuum heavy bottoms, decanted oil, light catalytic cycle oil, and combinations thereof; separating glass and steel fibers from said tires by using a horizontal screw reactor housed in a non-spherical chamber; inputting to a horizontal screw reactor a product-enhancing additive selected from the group consisting of compounds of bromine, chlorine, fluorine, iodine, sulfur, and combinations thereof; retorting at a maximum temperature below about 850 degrees Fahrenheit, thereby obtaining a carbonaceous material; and curing and partial oxidizing said carbonaceous material at a maximum temperature below about 1200 degrees Fahrenheit to obtain a carbonous residue.

Product-enhancing additives are typically bromides, chlorides, fluorides, iodides, and sulfur compounds that disassociate on heating. Examples of suitable product-enhancing additives are halide and sulfur compounds including, but not limited to, for example hydrogen chloride, methylene chloride, hydrogen iodide, hydrogen sulfide, dimethyldisulfide and combinations thereof.

The preferred embodiments of the present invention also includes the above mentioned process to recycle tires wherein the product-enhancing additive, selected from the group consisting of compounds of bromine, chlorine, fluorine, iodine, sulfur, and combinations thereof, further serves to enhance the capability of mercury capture.

Another preferred embodiment of the present invention includes the process to recycle tires, described above, wherein the process further comprises the step of preheating the tires prior to the step of digesting the tires. It is preferred that the tires are preheated to a temperature in the range of about 250 degrees Fahrenheit to about 400 degrees Fahrenheit.

According to other preferred embodiments, the step of digesting the tires comprises digesting the tires with a residence time in the range of about 10 minutes to about 1 hour.

The preferred embodiments of the present invention include the carbonous residue made by the above described process to recycle tires wherein the carbonous residue comprises about 0.5% to 10% sulfur by weight. It is more preferred that the carbonous residue comprises about 3% to about 6% sulfur by weight.

Another preferred embodiment of the present invention comprises the carbonous residue made by the above described process to recycle tires wherein the sulfur content is from about 0.5% to about 3.0%, and further comprising a halogen compound content in the range of about 0.2% to about 5.0% by weight.

In another preferred embodiment of the present invention includes the carbonous residue made by the above described process to recycle tires, wherein the percent by weight of carbon is in the range of about 55% to about 85%, and further comprising hydrogen in the range of about 1.1% to about 5.0% by weight, nitrogen in the range of about 0.3% to about 1.1% by weight, sulfur in the range of about 1.9% to about 4.0% by weight, oxygen in the range of about 1.1% to about 8.0% by weight, and a chlorine content of less than about 0.2%. It is more preferred that the carbonous residue further comprises a nickel content in the range of about 0.01% to about 0.12% by weight, a phosphorous content of less than about 0.17%, a silicon content in the range of about 1.0% to about 5.5% by weight, a titanium content in the range of about 0.2% to about 0.75% by weight, and zinc in the range of about 1.0% to about 6.0%.

Another preferred embodiment of the invention includes the carbonous residue made by the above described process wherein the carbonous residue comprises about 3% to 6% sulfur by weight and further comprises zinc in the range of about 1.0% to about 6.0% by weight.

The preferred embodiments of the present invention include an apparatus for recycling tires, comprising: a tire feed hopper disposed to receive a mixture of pulverized, steel-free rubber and oil, and having a heating means for heating the mixture; a fired heater disposed to receive the mixture from the tire feed hopper, thereby further heating the mixture; a separator for separating the mixture into a liquid component and a gas component; a horizontal screw reactor disposed to receive the liquid component and produce a carbonous residue from the liquid component; and a solid product receiver vessel disposed to receive the carbonous residue. The fired heater may be gas fired or oil fired.

Another embodiment of the invention includes the above described apparatus which further comprises a condenser disposed to receive the gas component from the separator; an additional separator disposed to receive the output of the condenser; whereby the additional separator has a gas port and a liquid port, thereby providing for capture of oils from the liquid port, and gasses from the gas port. A more preferred apparatus further comprises a third separator disposed to receive the output of the horizontal screw reactor; whereby the additional separator has a gas port and a liquid port, thereby providing for capture of oils from the liquid port, and gasses from the gas port. It is most preferred that the apparatus further comprises an additive input port disposed to supply additives to the horizontal screw reactor.

DETAILED DESCRIPTION

The present invention provides a method for producing a carbonous residue from recycled tires. In particular, the present invention provides a method for producing a carbonous residue that is well suited to the capture of mercury (Hg).

The present invention accomplishes this by providing a product having increased levels of sulfur and halogens as compared with that of the prior art processes, resulting in a carbonous residue well suited for Hg capture. The present invention makes use of the zinc inherent in tires.

Figure 1:
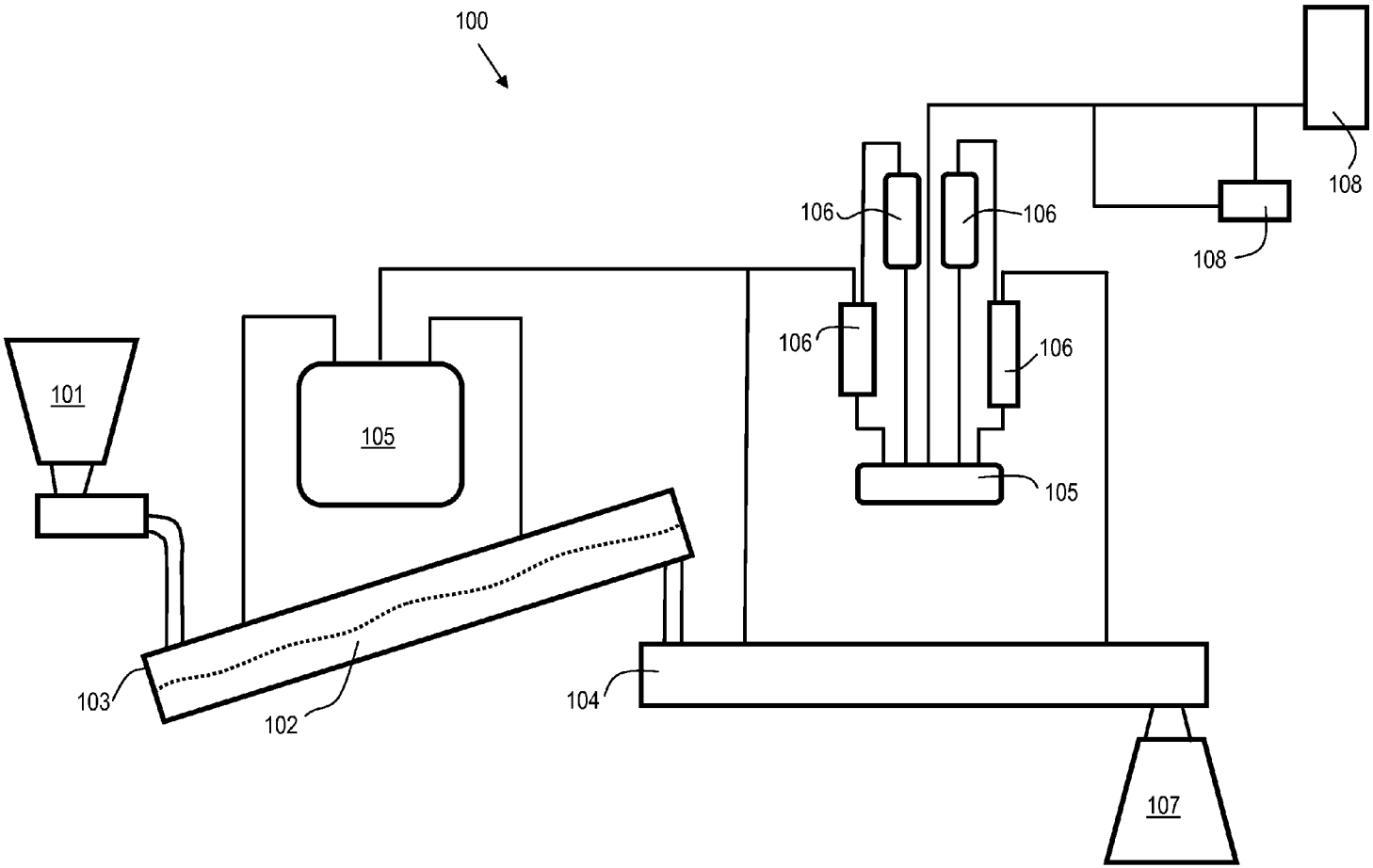
FIG. 1 Prior Art
FIG. 1 shows a prior art apparatus for implementing the process of the present invention.

The process may be implemented in an apparatus such as that disclosed in FIG. 1 of '691.

In one aspect of the present invention, a product enhancing additive is added to increase the efficiency of Hg capture.

The additive may be selected from the group consisting of compounds of bromine, iodine, fluorine, chlorine, sulfur, and combinations thereof. The compounds may be organic or inorganic combinations.

In another aspect of the present invention, the additive is added in the horizontal screw reactor of the apparatus. It is preferable to add the additive, which comprises additional sulfur and/or halogen compounds following the separation of the tire materials and the oils, to avoid introducing the compounds to the oil.

In another aspect of the present invention, the process achieves a time-temperature relationship to dissolve and depolymerize at a severity that avoids degradation and retrograde reactions of the monomers and oils and minimizes changes to the carbonous residue, such as surface area and pore size.

In another aspect of the present invention, a product of carbonous residue is produced, having a sulfur content in the range of 0.5% to 10%, and more preferably ranging from 3% to 6%.

In another aspect of the present invention, a product of carbonous residue is produced, having a halogen content in the range of 0.2% to 5.0%, and sulfur in the range of 0.5% to 3.0%.

For the purpose of providing context for the present invention, the prior art apparatus for implementing the process of the present invention will be briefly described here. The two-step continuous reactor 100 shown in FIG. 1 consists of several basic physical units. A tire feed hopper 101 feeds tires (chopped into smaller pieces, typically less than 3 inches in height and width) into a digesting oil 102 which occupies the lower region of an inclined screw reactor 103 whose upper portion serves as a retort. A horizontal screw reactor 104 serves as a curing/drying reactor. Liquid product receiver vessels 105 collect product light oil both before and after condensers 106. A solid product receiver vessel 107 collects carbonous residue product. A gas measurement system 108 monitors the process, and nitrogen bleed enhances vapor recovery. Without employing the curing/drying reactor a carbonaceous material is produced that contains considerable, up to about ten weight percent, residual light oil. A better carbonaceous material product, now referred to as carbonous residue, is produced if the curing/drying reactor lowers this residual oil concentration to below about one weight percent.

The present invention provides a new process for using the aforementioned apparatus to make a product suitable for Hg capture from recycled tires. Tires and oils are transported via a horizontal and vertical feed screw to the first stage, primary inclined screw reactor 103. The function of the reactor 103 is to digest tires with oils in the temperature range of about 600.degree.-750.degree. F. and begin separation of glass and steel fibers from the rest of the tire components. The retorting process takes place at a maximum temperature in the range of about 800 to 850 degrees Fahrenheit, and occurs in the upper section of reactor 103. Reactor 104 is approximately horizontal, and is used for curing and drying the carbonaceous material. The carbonaceous material is cured within reactor 104 at a maximum temperature below about 1,200 degrees Fahrenheit.

In one embodiment, the reactors used are about 5 inches in diameter, and have a length of about 10 feet. The feed rate preferably ranges from about 10-30 pounds per hour of the recycled tire mixture fed into tire feed hopper 101. The residence time of material (how much time the material spends within the reactor portions of the apparatus) ranges from about 10 minutes to about 1 hour. The residence time can be decreased, thereby increasing throughput, by preheating the tire feed prior to inputting it into tire feed hopper 101. A preheated feed digester can be used to enhance heat transfer and depolymerization. In one embodiment, the tire feed is preheated to a temperature in the range of about 250 degrees Fahrenheit to about 500 degrees Fahrenheit.

Oil types processed in this invention include waste motor oil (WMO), new 600 weight cylinder oil (NCO), trim gas oil (TGO), vacuum heavy bottoms (VHB), light catalytic cycle oil (LCCO), and decanted oils (DO). Other sources of oils or residuum are potentially usable with appropriate changes in reactor operating conditions.

A product-enhancing additive being selected from the group consisting of compounds of iodine, bromine, chlorine, fluorine, sulfur, and combinations thereof, may be added to the product during the process to input to enhance the capability of mercury capture. In one embodiment, the additive is added to the product at the horizontal reactor 104, prior to completion of the curing of the carbonous residue.

Figure 2:
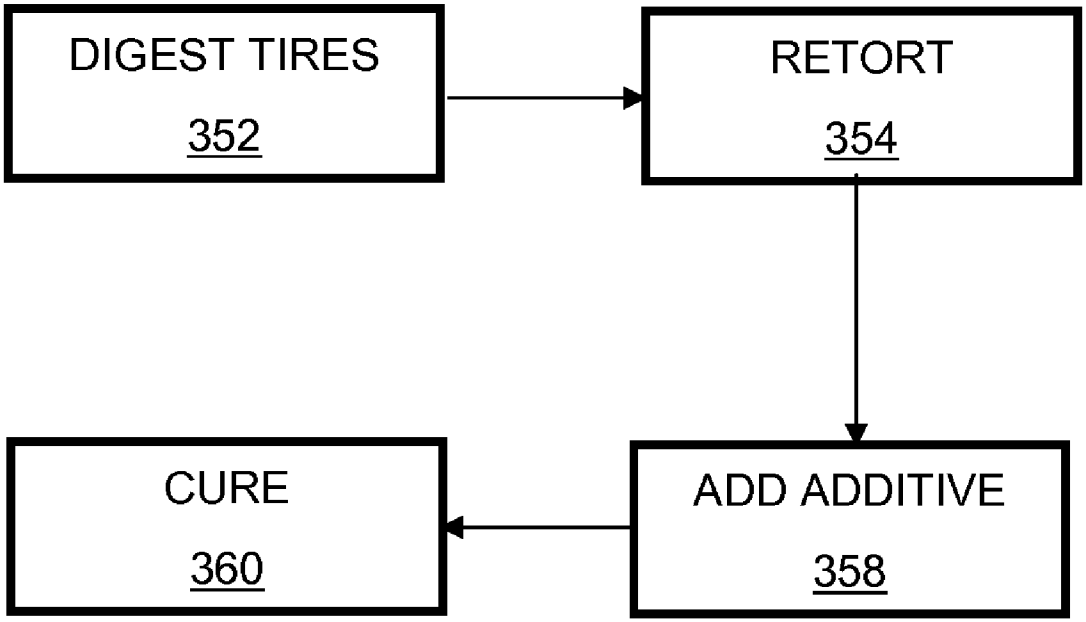
FIG. 2 shows a flowchart indicating process steps for the present invention.

FIG. 2 shows a flowchart indicating process steps for the present invention. In step 352 the tires are digested in the inclined reactor (103 of FIG. 1). This process also separates most of the glass and steel fibers from the rubber portion of the tires. In step 354, the mixture within the inclined reactor (103 of FIG. 1) is retorted at a maximum temperature below about 850 degrees. In step 358 a product enhancing additive is added, typically to the horizontal reactor (104 of FIG. 1). This additive is preferably selected from compounds in group consisting of bromine, chlorine, fluorine, iodine, and sulfur compounds and combinations thereof. The halogen compounds and the sulfur compounds are contemplated to be either organic or inorganic compounds. In step 360, the carbonaceous material is cured at a maximum temperature less than about 1,200 degrees Fahrenheit in the horizontal reactor (104 of FIG. 1). The carbonaceous material can also be cured in a carbon monoxide (CO) reducing atmosphere to improve the structure and efficiency of the carbonous residue and process.

Figure 3:
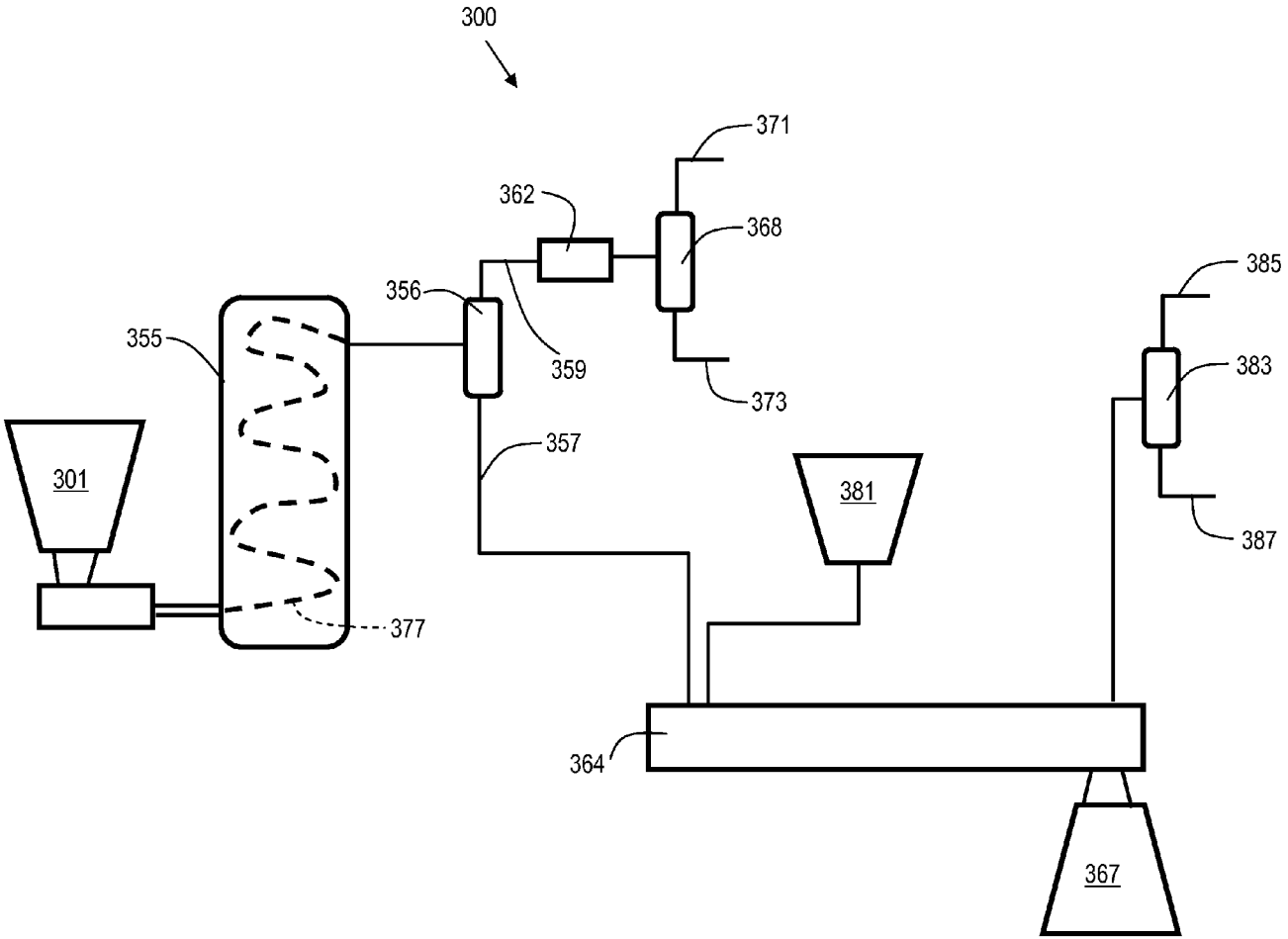
FIG. 3 shows an apparatus for implementing the process of the present invention.

FIG. 3 shows an apparatus 300 for implementing the process of the present invention. A mixture of oil and pulverized, steel-free rubber is fed into tire feed hopper 301. Tire feed hopper 301 has a heating means such as an electric, fired, or liquid heating mechanism, and heats the mixture to a temperature in the range of about 250 degrees Fahrenheit to about 500 degrees Fahrenheit. The mixture is then fed to a fired heater 355. Fired heater may be a gas fired heater, coal fired heater, or an oil fired heater. However, the present invention is not limited to these heating technologies. Any suitable heating technology that can achieve the needed temperatures can be used without departing form the scope of the present invention.

Fired heater 355 comprises circulation system 377 which circulates the mixture in a heated environment, which increases the temperature of the mixture to about 825 to 875 degrees Fahrenheit. After exiting the fired heater 355, the mixture is then fed to separator 356, where the mixture is separated into a liquid component and a gas component. Separator 356 has two exit ports: liquid port 357 and gas port 359. The liquid component exits the separator 356 via liquid port 357, and enters horizontal screw reactor 364. Additive input port 381 allows one or more of the previously mentioned additives to be input into the screw reactor to enhance the efficiency of the operation. Within the screw reactor, the liquid component is heat cured at a temperature in the range of about 850-1,200 degrees Fahrenheit. A solid product receiver vessel 367 collects the carbonous residue product that is produced via the horizontal screw reactor. The gas component produced in separator 356 exits via gas port 359, and enters condenser 358. In one embodiment, the condenser 358 is liquid cooled. The output of condenser 358 is then fed to separator 368. Separator 368 has two exit ports: gas port 371 and liquid port 373. Light oils are may be captured from port 373, and gasses may be captured from port 371. The oils and gases remaining within screw reactor 364 after the heat curing process are routed to separator 383. The gas component produced in separator 383 exits via gas port 385. The liquid component produced in separator 383 exits via liquid port 387.

It is to be understood that the present invention may have various other embodiments. Furthermore, while the form of the invention herein shown and described constitutes a preferred embodiment of the invention, it is not intended to illustrate all possible forms thereof. It will also be understood that the words used are words of description rather than limitation, and that various changes may be made without departing from the spirit and scope of the invention disclosed. The scope of the invention should not be limited solely to the examples given.

The invention claimed is:

1. A process to recycle tires comprising in sequence:

digesting the tires in a fired heater at a maximum temperature below about 750 degrees Fahrenheit using an oil, said oil being selected from the group consisting of residuum, waste motor oil, new 600 w cylinder oil, trim gas oil, vacuum heavy bottoms, decanted oil, light catalytic cycle oil, and combinations thereof;

separating the gaseous component from said tires by using a separator;

separating glass and steel fibers from said tires by using a horizontal screw reactor housed in a non-spherical chamber;

adding a product-enhancing additive, said product-enhancing additive being selected from the group consisting of compounds of bromine, chlorine, fluorine, iodine, and combinations thereof;

retorting at a maximum temperature below about 875 degrees Fahrenheit, thereby obtaining a carbonaceous material; wherein said product-enhancing additive produces a carbonaceous material comprising 0.2% to about 5.0% halogen by weight.

2. The process according to claim 1 wherein said product-enhancing additive, further serves to enhance the capability of said carbonaceous material to capture mercury.

3. The process according to claim 1 wherein said product-enhancing additive being selected from the group consisting of compounds of bromine, chlorine, fluorine, iodine, and combinations thereof, is input to the horizontal screw reactor.

4. The process according to claim 1, further comprising the step of preheating the tires and oil prior to the step of digesting the tires in a fired heater.

5. The process according to claim 4, wherein the step of preheating the tires and oil comprises preheating the tires and oil to a temperature in the range of about 250 degrees Fahrenheit to about 400 degrees Fahrenheit.

6. The process according to claim 1, wherein the step of digesting the tires in a fired heater comprises digesting the tires with a residence time in the range of about 10 minutes to about 1 hour.

7. The process according to claim 1, wherein the product-enhancing additive fed into the reactor produces said carbonaceous material comprising about 0.5% to 10% sulfur by weight.

8. A process to recycle tires comprising in sequence:

digesting the tires in a fired heater at a maximum temperature below about 750 degrees Fahrenheit using an oil, said oil being selected from the group consisting of residuum, waste motor oil, new 600 w cylinder oil, trim gas oil, vacuum heavy bottoms, decanted oil, light catalytic cycle oil, and combinations thereof;

separating the gaseous component from said tires by using a separator;

separating glass and steel fibers from said tires by using a horizontal screw reactor housed in a non-spherical chamber;

adding a product-enhancing additive, said product-enhancing additive being selected from the group consisting of compounds of bromine, chlorine, fluorine, iodine, and combinations thereof;

retorting at a maximum temperature below about 875 degrees Fahrenheit, thereby obtaining said carbonaceous material; and curing said carbonaceous material at a maximum temperature below about 1200 degrees Fahrenheit, whereby a carbonous residue is produced; wherein said carbonous residue comprises 0.2% to about 5.0% halogen by weight.

9. The process according to claim 7 wherein said product-enhancing additive, further serves to enhance the capability of said carbonous residue to capture mercury.

10. The process according to claim 7 wherein said product-enhancing additive being selected from the group consisting of compounds of bromine, chlorine, fluorine, iodine, and combinations thereof, is input to the horizontal screw reactor.

11. The process according to claim 7, further comprising the step of preheating the tires and oil prior to the step of digesting the tires in a fired heater.

12. The process according to claim 10, wherein the step of preheating the tires and oil comprises preheating the tires to a temperature in the range of about 250 degrees Fahrenheit to about 400 degrees Fahrenheit.

13. The process according to claim 7, wherein the step of digesting the tires in a fired heater comprises digesting the tires with a residence time in the range of about 10 minutes to about 1 hour.

14. The process according to claim 8, wherein the product-enhancing additive fed into the reactor produces said carbonous residue comprising about 0.5% to 10% sulfur by weight.

* * * * *